US008172105B2

(12) United States Patent
Smith

(10) Patent No.: US 8,172,105 B2
(45) Date of Patent: May 8, 2012

(54) CONTAINER FOR STORING AND DISPENSING SMALL SOLID MATERIALS

(76) Inventor: William G. Smith, Rancho Palos Verdes, CA (US)

( * ) Notice: Subject to any disclaimer, the term of this patent is extended or adjusted under 35 U.S.C. 154(b) by 1362 days.

(21) Appl. No.: 11/725,935

(22) Filed: Mar. 19, 2007

(65) Prior Publication Data

US 2008/0230434 A1 Sep. 25, 2008

(51) Int. Cl.
*B65D 43/26* (2006.01)

(52) U.S. Cl. ..... 220/264; 220/262; 220/263; 220/524

(58) Field of Classification Search ..... 220/253, 220/255, 262, 263, 264, 502, 507, 524, 553, 220/260; 221/94, 132, 224, 225; 222/144; 312/125, 138.1, 200
See application file for complete search history.

(56) References Cited

U.S. PATENT DOCUMENTS

| | | | | | |
|---|---|---|---|---|---|
| 308,634 | A | * | 12/1884 | Seineoke | 217/56 |
| 360,608 | A | * | 4/1887 | McKinnon | 222/438 |
| 1,481,922 | A | * | 1/1924 | Miller | 220/264 |
| 1,552,693 | A | * | 9/1925 | Gray | 131/236 |
| 1,921,933 | A | * | 8/1933 | Levenberg et al. | 232/43.5 |
| 2,200,531 | A | * | 5/1940 | Bishelany | 4/267 |
| 2,408,132 | A | * | 9/1946 | Weeks | 296/223 |
| 2,430,222 | A | * | 11/1947 | Goldbert | 220/826 |
| 2,470,271 | A | * | 5/1949 | Steinbacher | 248/97 |
| 2,633,397 | A | * | 3/1953 | Tiedeman | 221/225 |
| 2,663,529 | A | * | 12/1953 | Lyttaker | 248/147 |
| 2,707,379 | A | * | 5/1955 | Guior | 312/240 |
| 3,498,136 | A | * | 3/1970 | Le May | 73/426 |
| 4,779,753 | A | * | 10/1988 | Capy | 220/522 |
| 5,170,904 | A | * | 12/1992 | Neuhaus | 220/262 |
| 5,868,476 | A | * | 2/1999 | Samborn et al. | 312/125 |
| 6,196,407 | B1 | * | 3/2001 | Liu | 220/263 |
| 6,626,317 | B2 | * | 9/2003 | Pfiefer et al. | 220/263 |
| 6,837,393 | B1 | * | 1/2005 | Kuo | 220/263 |
| 2004/0004080 | A1 | * | 1/2004 | Yang et al. | 220/263 |
| 2005/0135975 | A1 | * | 6/2005 | Su et al. | 422/103 |
| 2008/0230434 | A1 | * | 9/2008 | Smith | 206/538 |

* cited by examiner

*Primary Examiner* — Anthony Stashick
*Assistant Examiner* — Brett Edwards
(74) *Attorney, Agent, or Firm* — Stetina Brunda Garred & Brucker; Lowell Anderson

(57) ABSTRACT

A container for storing and dispensing pills is provided. The container has a housing with an upper end and a lower end and a plurality of compartments therein. The compartments have an open end adjacent the upper end of the housing and a lower end adjacent the lower end of the housing. The lower end of each compartment has an opening with a hinged door covering the opening. A cam having a cam surface is attached to the door so the cam rotates as the door opens and closes. A cam follower pin abuts the cam surface and the cam follower pin is constrained to move along a predefined path. The doors can be opened manually one at a time or all together by pushing downward on a centrally located handle at the top of the container. When opening all the door simultaneously the handle can be retained in the door open position by sliding two flanges beneath the handle into a slot and rotating the handle left or right. The housing is mounted to a rotatable lazy-Susan base.

17 Claims, 10 Drawing Sheets

CONTAINER FOR STORING AND DISPENSING SMALL SOLID MATERIALS

CROSS-REFERENCE TO RELATED APPLICATIONS

Not Applicable

STATEMENT RE: FEDERALLY SPONSORED RESEARCH/DEVELOPMENT

Not Applicable

BACKGROUND

Consumers who take vitamin pills often purchase larger quantities of pills to save money. These pills are usually contained in larger jars with screw caps. To dispense pills it is necessary to remove the jar from its storage location and unscrew the cap of each jar to pour out the required number of pills. Flip tops on the caps still require removing and replacing each pill jar from its storage location. If a consumer takes multiple types of pills this process becomes a cumbersome and time consuming procedure. Additionally, pharmacies dispense pills by opening a storage jar, selecting and counting out the required number of pills, and placing the selected pills in another smaller pill jar which is labeled with instructions related to the use of the pills. Again, this process is time consuming. Further, without the pharmacist opening the storage jar and looking inside the jar it is difficult to visually see how many pills remain. This complicates restocking and an uninterrupted supply of the pills to the customers. There is thus a need for an improved mechanism and method of storing and providing pills to person taking multiple pills.

BRIEF SUMMARY

To avoid the described problems with dispensing pills the present mechanism and method was devised. A pill dispenser is provided having a plurality of compartments, preferably six, each with a spring loaded door which can be opened individually, by lifting a selected door individually by hand, or all doors opened simultaneously by pushing down on the centrally located handle at the top of the container.

When a spring loaded door is operated individually, by hand, it returns to the closed position when the door is released, with a resilient member such as a spring closing the door. When all the doors are opened simultaneously, by pushing the centrally located handle downward, the handle can be locked in the down position thereby holding all the doors in the open position. The handle is secured in the down position by rotating the handle so that a flange beneath the handle is slid into a slot on the container. Further rotating the handle to align the flange with the slot releases the handle so that a handle return spring can return the handle to its extended position. When the handle moves upward the return springs on the doors close all the doors. A cam mechanism is located on a projection extending inward from the door. The cam engages a pin shaped cam follower which moves up or down according to the rotational position of the door from the open to the closed position.

Each compartment has a horizontal portion covered by the door, and also has a vertical portion extending upwards toward the top of the container. A removable lid at the top of the container allows the pills to be placed into each compartment where gravity urges them downward into the horizontal dispensing portion. Preferably, but optionally, the bottom of the container rests on a lazy-Susan type of base to allow rotation of the compartments. The dispenser, or at least the outer portion of the compartments, are preferably made of material that is sufficiently transparent, or translucent, so that a user can see the pills and thus more readily gauge the number of pills remaining for estimating usage and for restocking.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1A:
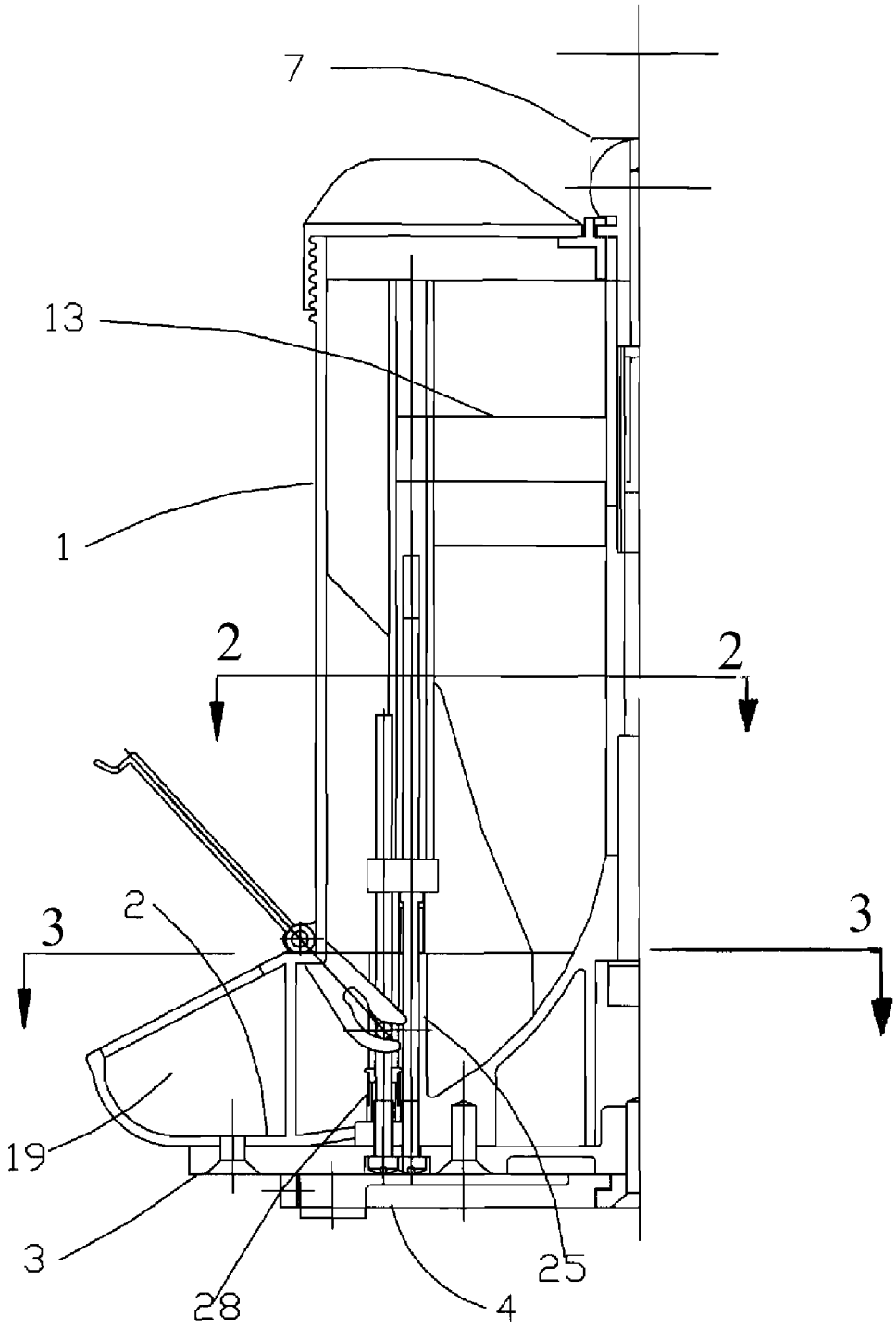
FIG. 1*a* is a sectional view taken along section 1-1 of FIG. 2 with a door raised.
Figure 1B:
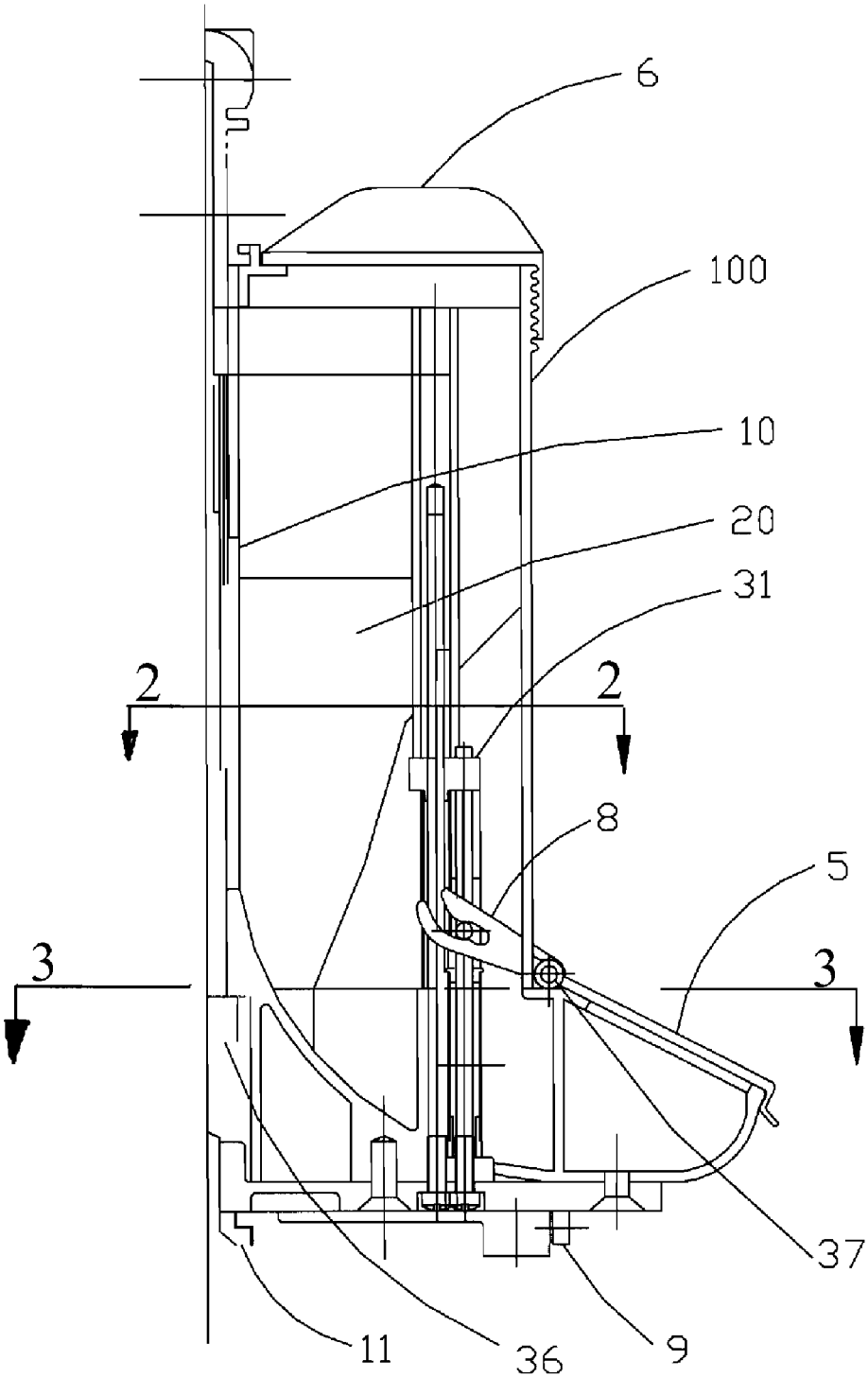
FIG. 1*b* is a sectional view taken along section 1-1 of FIG. 2 with a door lowered.
Figure 2:
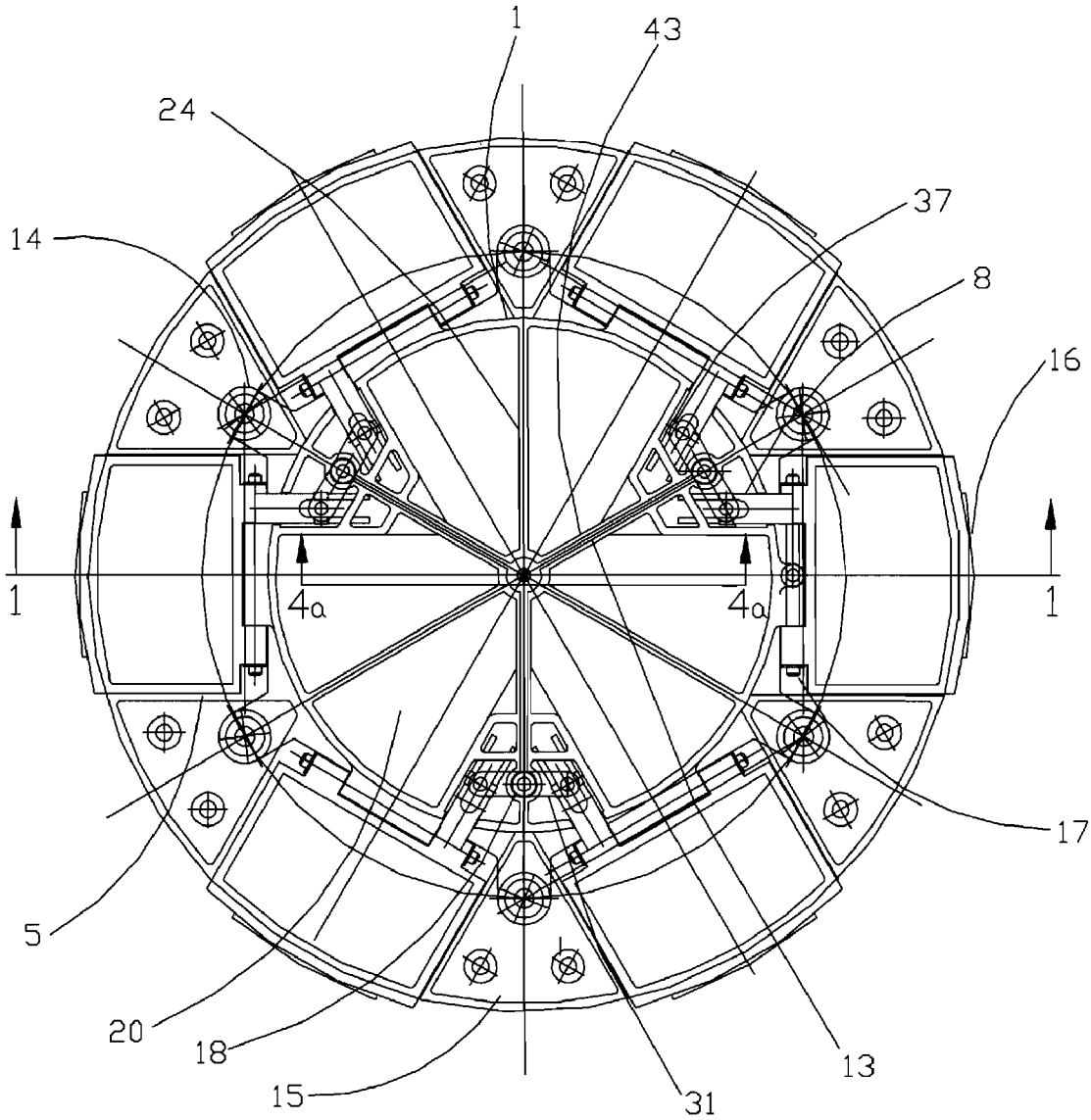
FIG. 2 is a sectional view taken along Section 2-2 of FIG. 1.
Figure 3:
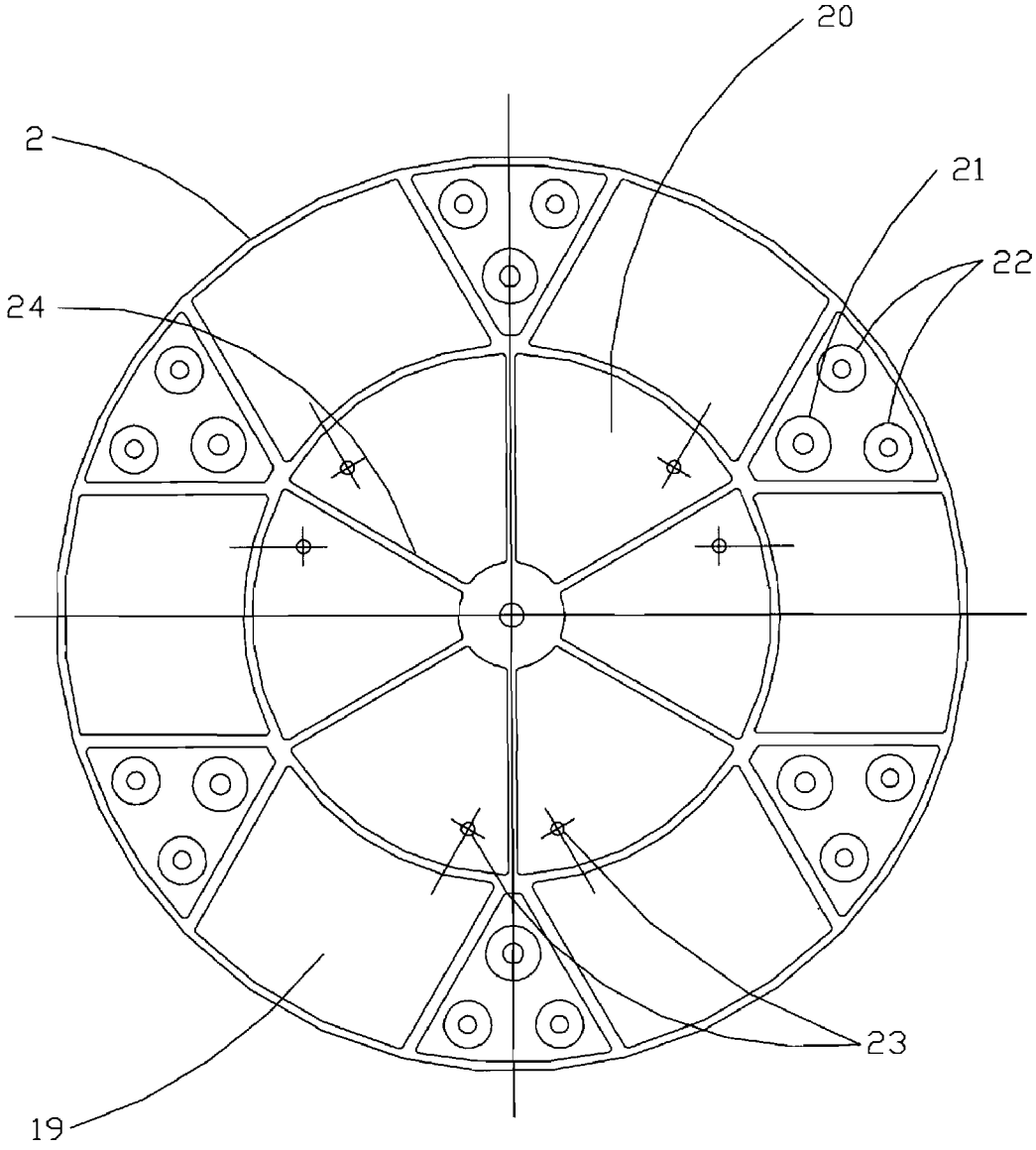
FIG. 3 is a sectional view taken along Section 3-3 of FIG. 1.

Referring to FIGS. 1-7, the dispenser 100 (FIG. 1) is preferably used for dispensing pills, but may be used to dispense other items. The dispenser 100 has a plurality of compartments 19 (FIGS. 1,3,5*a*), preferably six such separate compartments or chambers. The compartments can have various shapes and are shown as having a generally J-shape with a lower, generally horizontal portion 19 and a vertical portion 20 joined by an inclined or curved back wall 39 (FIG. 1). The shape of the dispenser 100 can vary, but is preferably polygonal or cylindrical, and is shown as having cylindrical section 1 (FIGS. 1, 2) formed largely by the vertical portions of the compartments 20 (FIGS. 1, 2, 3) and horizontal compartments 19 (FIGS. 1, 3, 5*a*). The dispenser 100 has a base 2 (FIGS. 1, 3) which is generally flat and which rests on or is connected to a mounting plate 3 (FIGS. 1, 5*a*). The mounting plate 3 is preferably, but optionally constructed like a lazy-Susan, with a lazy-Susan bottom plate 4 (FIGS. 1, 5*a*) and rollers 9 (FIG. 1, 5*a*) to allow rotation of the base 2 relative to the lazy-Susan and its bottom plate 4. The lazy-Susan rotates around the centrally located spacer 11 (FIG. 1) to maintain alignment and to secure the bottom plate 4 to the mounting plate 3.

Each horizontal compartment 19 has an access door 5 (FIGS. 1, 2, 5*a*) rotatably fastened at hinge 17 (FIGS. 1, 2, 5*a*) in order to selectively cover an opening in the lower portion of the compartment 19 with which the door 5 is associated. The lower opening in the compartment 19 is located and sized to allow a person to easily remove items such as pills, from the compartment.

The upper end of the dispenser 100 has a lid 6 (FIG. 1) which may be closed or alternatively removed in order to allow access to the compartments 20. The upper portion of the compartments 20 thus open onto the top of the dispenser 100 and are covered by the lid 6. Preferably the lid 6 comprises a flanged screw top having internal threads on the flange that mates with external threads at the top of the dispenser 100 to removably fasten the lid 6 to the dispenser 100.

Figure 7A:
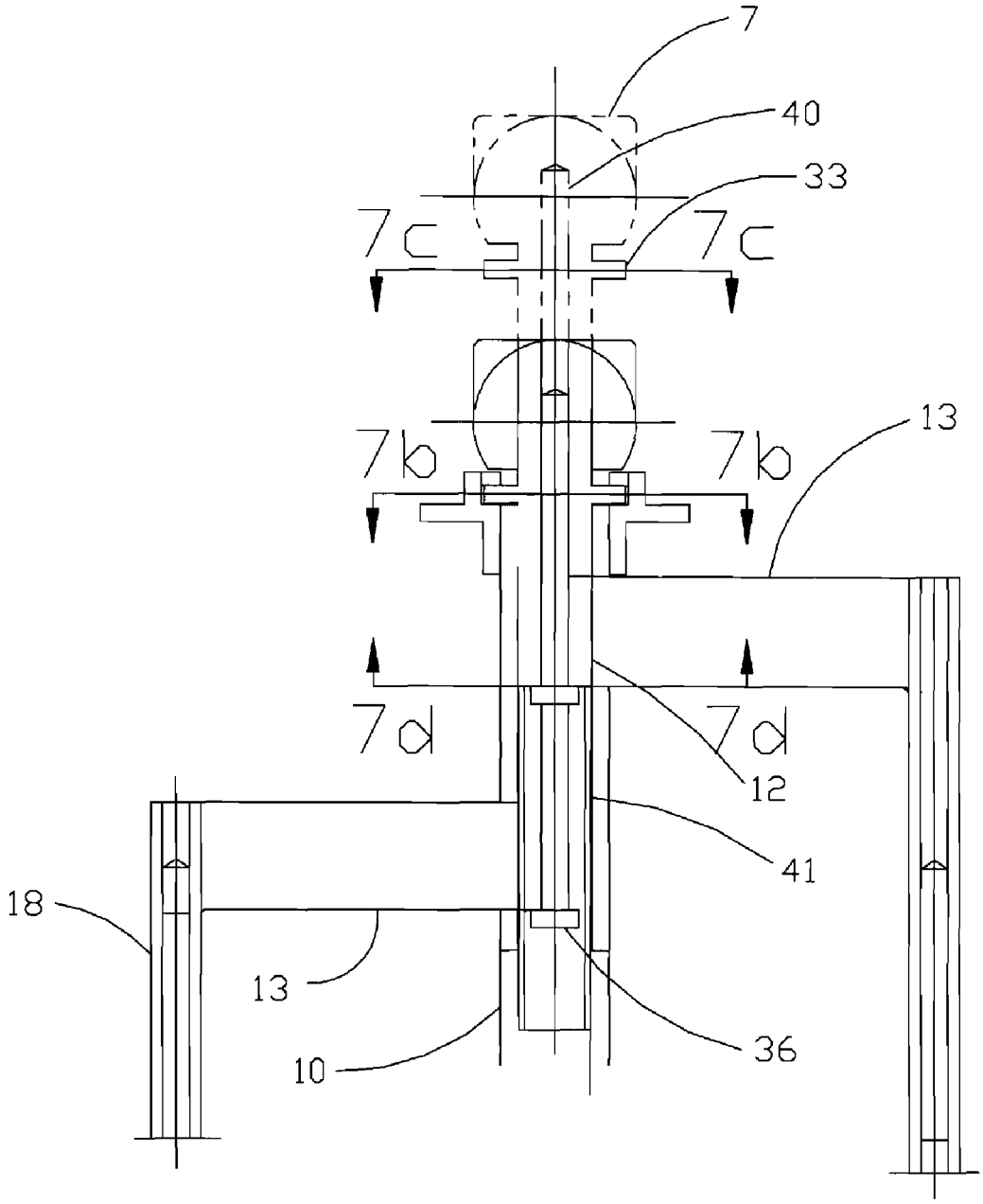
FIG. 7*a* is a partial view showing the handle actuating mechanism.
Figure 7C:
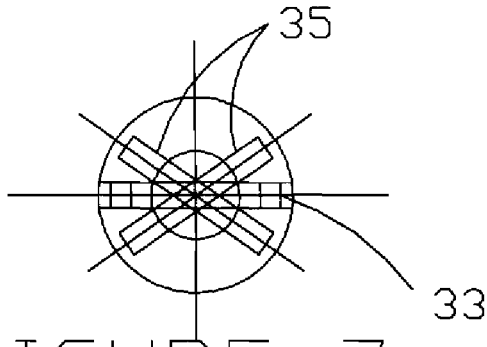
FIG. 7*c* is a sectional view taken along Section 7*c*-7*c* of FIG. 7*a;*
Figure 7B:
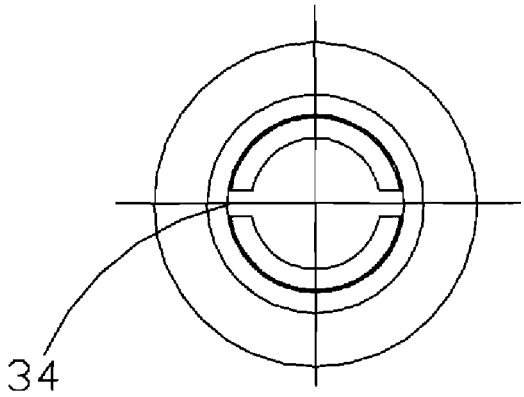
FIG. 7*b* is a sectional view taken along Section 7*b*-7*b* of FIG. 7*a;*
Figure 7D:
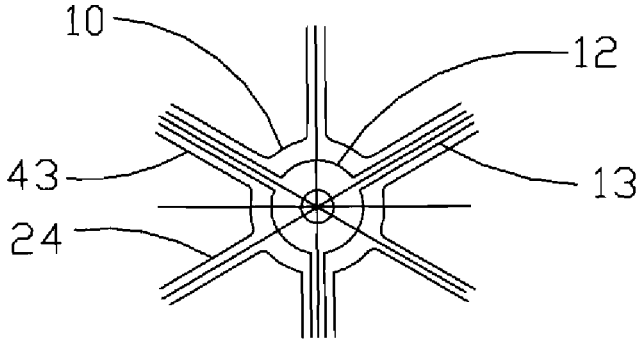
FIG. 7*d* is a sectional view taken along Section 7*d*-7*d* of FIG. 7*a.*

A centrally located handle 7, preferably but optionally formed like a ball on the end of a shaft (FIGS. 1, 6, 7) is used to open all the doors 5 simultaneously when the handle is pushed downward. It also acts as a lifting device. The handle 7 is retained by a retaining pin 32 (FIG. 7) which is threaded into the handle by threaded rod end 40 (FIG. 7). When the handle 7 is pushed downward flanges on the handle push against the tube support hub 12 (FIGS. 6, 7) which is attached to three equally spaced plates 13 (FIGS. 1, 2, 5*a*, 7) which move downward. The outermost edges of the plates 13 are attached to elongated members such as tubes 18 (FIGS. 2, 4, 5, 6, 7) which move downward with handle motion. A compression spring 41 (FIG. 7) returns the plates 13 and handle 7 to the extended position. The retaining pin 32, spring 41, tube support hub 12 and plates 13 are all supported by the central shaft 10 (FIGS. 1, 6, 7) which is a part of the cylinder. The plates 13 slide within three equally spaced slots in the central shaft 10 (FIG. 7*a*). Immediately beneath the handle 7 is a lower flange 33 (FIG. 7*a*) which slides into a slot 34 (FIG. 7) and when rotated to the left or right stops 35 (FIG. 7*a*) prevents the handle 7 from returning to the extended position thereby holding the doors in their open positions.

A close-out plate 15 (FIG. 2) is preferably, but optionally, provided to cover any open areas between the doors 5 as shown in FIG. 2. The shape of the close-out plate 15 will vary with the shape of the compartments 19, 20.

Referring to FIG. 2, six webs 24 (FIGS. 2, 3) are formed inside the cylinder 1 to form and define the sides of at least a portion of the upper compartments 20 and also preferably define the sides of the horizontal compartments 20. The number of webs will vary with the number of compartments 19, 20. The lower portion of each compartment 19 is preferably, but optionally, rectangular in shape rather than pie shaped, and thus pie-shaped sections are formed between the lower portions of each compartment 19. Attachment lugs 14 (FIG. 2) are located in these pie-shaped locations and attach cylinder 1 to the base 2 by posts 21 (FIG. 3) on the base 2. The base close-out plate 15 covers any open areas of the base 2 and is secured by any suitable fastener. The depicted embodiment uses screws threaded into posts 22 (FIG. 3) on the base 2.

Figure 4A:
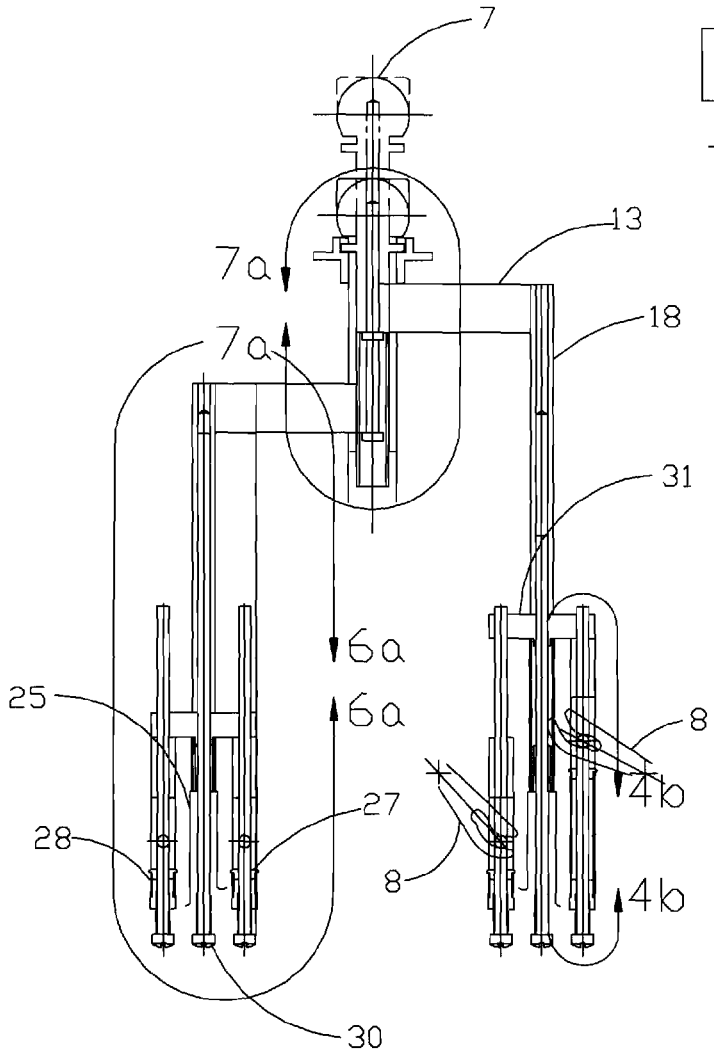
FIG. 4*a* is a partial view taken along section 4*a*-4*a* of FIG. 2, showing the entire door actuating mechanism, with the cam actuated portion enlarged.
Figure 4B:
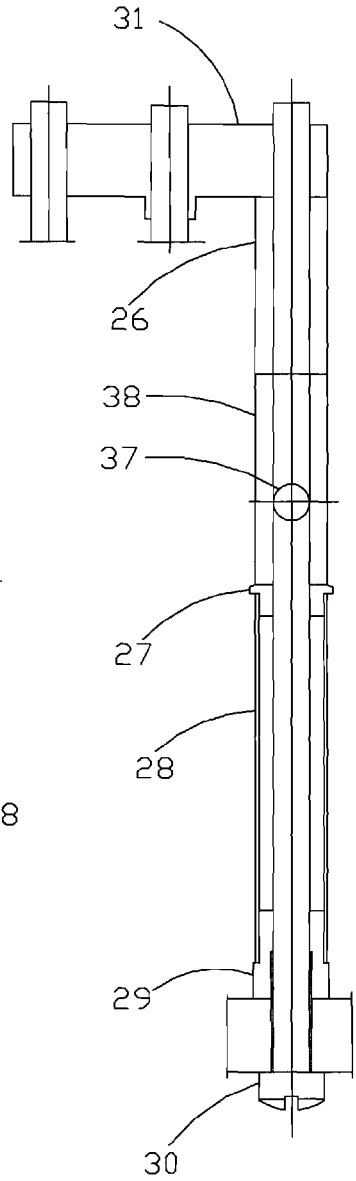
FIG. 4*b* is a plan view taken along section 4*b*-4*b* of FIG. 4*a;*
Figure 5B:
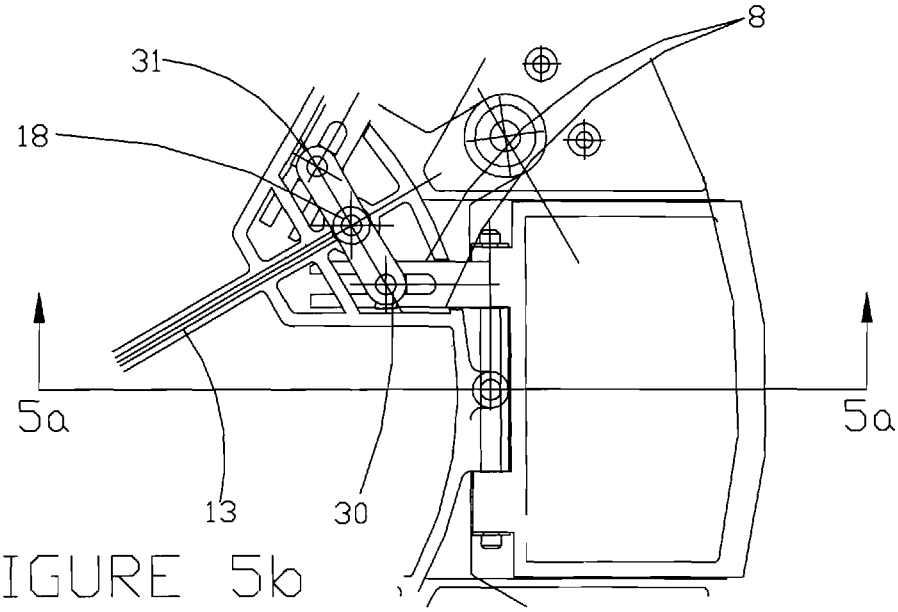
FIG. 5*b* is a partial section view showing a top view of the operation of the door and cam mechanism of FIG. 5*a;*
Figure 5A:
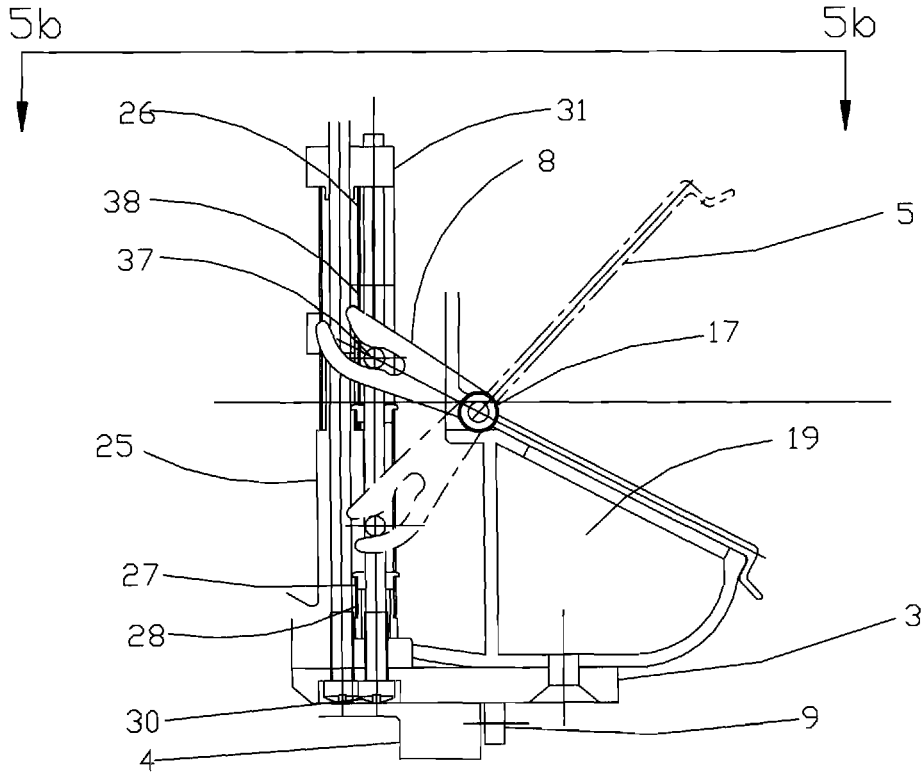
FIG. 5*a* is a partial section view taken along Section 5*a*-5*a* of FIG. 5*b*, showing a side view of the operation of a door and cam mechanism with the door raised.
Figure 5C:
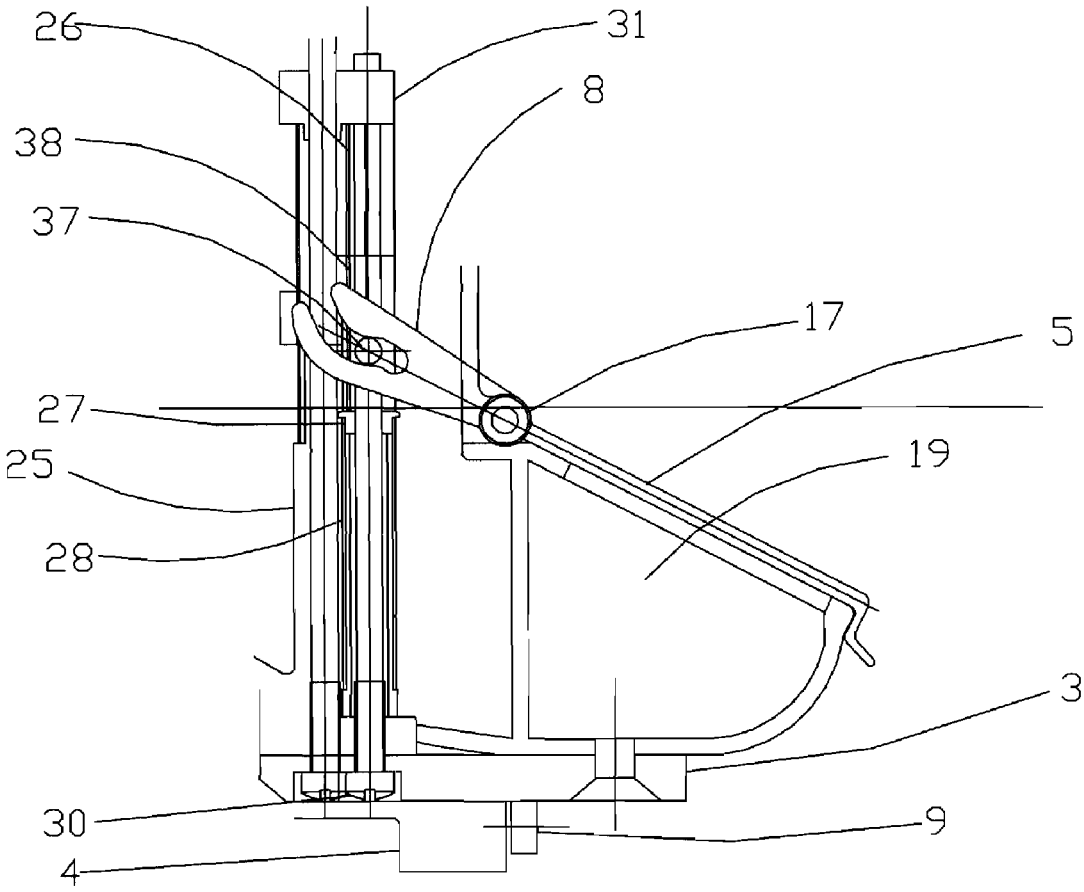
FIG. 5*c* is a partial section view taken along Section 5*a*-5*a* of FIG. 5*b*, showing a side view of the operation of a door and cam mechanism with the door lowered
Figure 6:
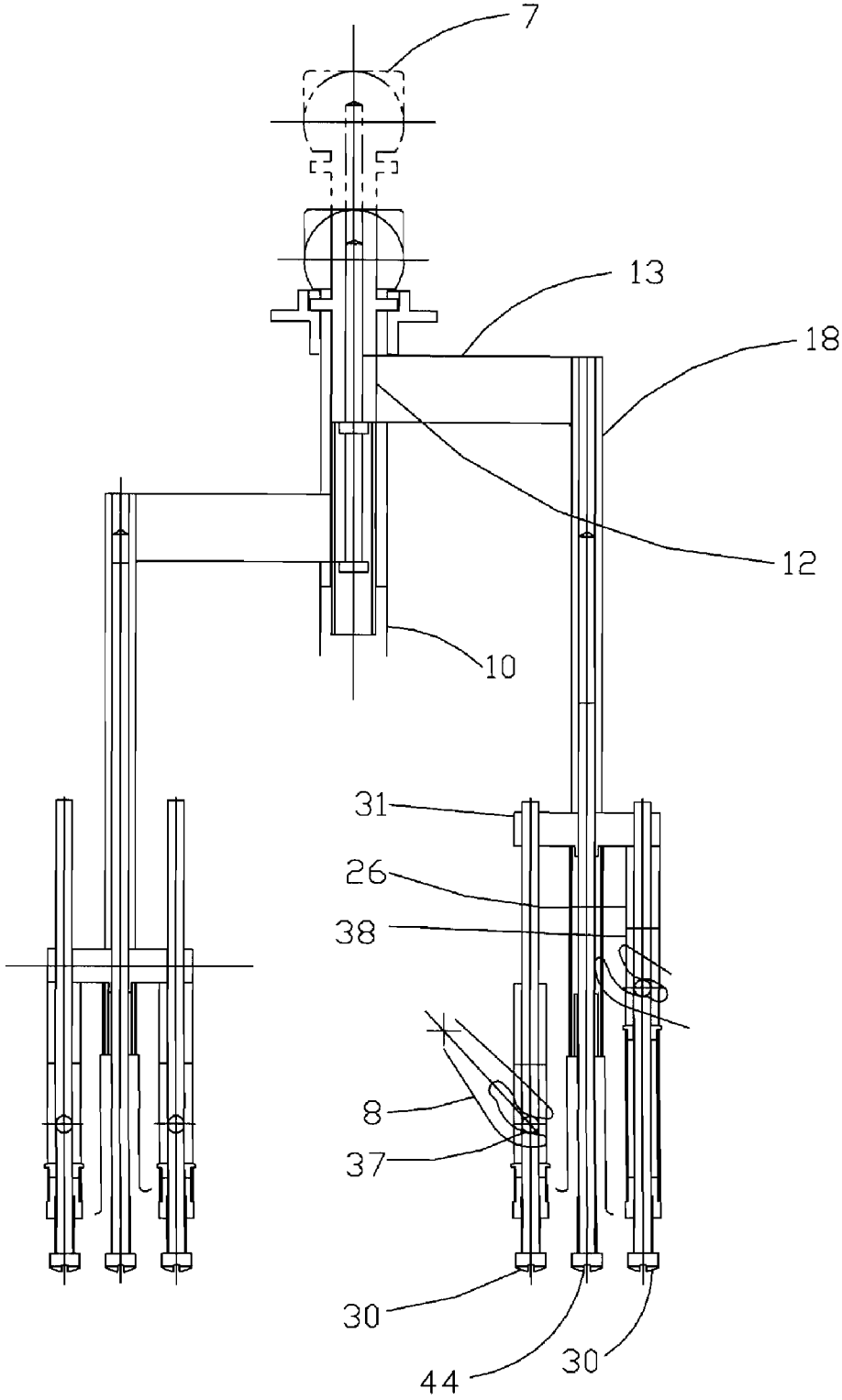
FIG. 6 is a partial view taken from Section 6*a*-6*a* of FIG. 4*a;*

FIG. 3 shows a cross-section through the container beneath the base close-out plate 15 and illustrates the six compartments 19 and the attachment points 21 on the base to connect the base to the cylinder 1 and attachment points 22 to connect the close-out plate 15. A base-to-cylinder screw 36 (FIG. 1) can also be used to attach the base 2 to the cylinder 1. FIGS. 4*a* and 4*b* shows a cross-section through the container depicting the entire door actuation mechanism in the door 5 open and closed positions, shown in a flat plane to illustrate its features for individual operation and simultaneous operation of the doors 5.

During use the lid 6 is removed or opened and pills or other items are placed in the upper, vertical portion of the desired compartment 20. The doors 5 are preferably closed during the loading process. The upper compartments 20 are preferably large enough that an entire container of pills or other items can be emptied into one of the compartments. The pills are guided into the lower horizontal portion of the compartment 19 by the curved or inclined back wall 39. As more pills abut the inclined back wall 39 the pills are urged toward the front of the lower portion adjacent to door 5. The lid 6 is then closed or refastened. After loading, the container is placed in its storage location for usage. When it is desired to dispense pills from the container 100, the container is rotated on its base 2 to the appropriate compartment door 5. The door 5 is opened by manually engaging a portion of the door. The door 5 could extend over the compartment 19 or could have a specifically shaped tab, both of which are included herein when referring to projecting tab 16 (FIGS. 1, 2). The projecting tab 16 is preferably located along the distal edge of the door but could be on a side of the door if it is manually accessible. As the door is opened the cam 8 (FIGS. 1, 2, 4,5*a*, 6) bears against the cam follower 37 (FIGS. 1, 2, 4, 5, 6) moving it downward compressing the spring 28 (FIGS. 1, 4, 5, 6) which is retained by upper retainer 27 (FIGS. 4, 5*a*, 6) and lower spring guide 29 (FIG. 4). The upper spacer 26 (FIGS. 1, 4, 5, 6), lower spacer 38 (FIGS. 1, 4, 5, 6), spring 28, upper retainer 27 ride along guide shaft 30 (FIGS. 4, 5*a*, 6) which is retained by threads in the base 2 at the shaft attach points 23 (FIG. 3). When the door is opened the pills or other items are then removed from the compartment 19 by fingers or spoons, etc. Once the pills are dispensed the doors 5 are closed by releasing the door tab 16 allowing the return spring 28 to close the doors.

When it is desired that all doors open and stay open simultaneously the centrally located handle 7 is moved to activate a linkage mechanism ultimately engaging cams 8 as best seen in FIGS. 1, 4, 6 and 7. The handle 7 and its shaft are pushed downward causing the three plates 13 to move downward within the three slotted webs 43 (FIGS. 2,7). The plates 13 have one end fastened to a tube support hub 12. The shaft portion of handle 7 passes through the center tube of the hub 12 so that a flange on the handle 7 abuts and pushes downward on the hub 12 and thus moves the plates 13 downward. The plates 13 extend outward from the hub with the other end of the plates being fastened to elongated members 18. The plates 13 extend laterally outward from the central handle 7. The plates 13 are preferably rectangular in cross section. While referred to as plates 13, they could take any form sufficient for the purpose. There is one plate 13 for each two compartments 19, so the number of plates will vary with the number of compartments. The three plates thus have elongated members 18 attached to their distal ends which move downward as the handle 7 is moved down. The elongated members 18 preferably comprise tubular members and referred to as such hereinafter.

The tubes 18 slide vertically along a retaining rod 44 (FIG. 6) which extends through the tubes. A bottom end of the rod 44 rests against and is preferably fastened to the mounting plate 3 (FIG. 1).

The tubes 18 bear against the crosspiece 31 (FIGS. 1, 2, 4, 5*a*, 6) pushing it downward against a resilient member such as compression spring 42 (FIG. 6) which optionally encircles the retaining rod 44 to provide a captive spring. The crosspiece 31 comprises several laterally or outwardly extending members each of which has an opening through which passes one end of the guide shaft 30. The downward motion of the crosspiece 31 in turn causes the crosspiece 31 to bear against upper spacer 26 (FIG. 6) on the guide shaft 30 causing the spacer 26 to move downward and bear on the lower spacer 38 which in turn moves downward. The lower spacer 38 is resiliently urged upward 26 by a resilient member such as coil spring 28 which encircles the guide rod 30. The lower spacer 38 contains the cam follower 37. The cam follower 37 is optionally in the shape of a pin 37 extending from opposing sides of the lower spacer 38.

The spacers 26 and 38 are preferably tubular sleeves through which the guide rod 30 extends so the spacers 26, 38 move along the length of the guide shaft. The guide shaft 30 is vertically oriented, parallel to the retaining rod. Thus, movement of the handle 7 and its single shaft move the plates 31 to move one or more cross-pieces. Each cross-piece moves two cam followers 37. Each cam follower 37 moves one door 5, with the cam follower 37 moving along the vertical axis of guide shaft 30 while the cam 8 (and door 5) rotates as it moves past the follower 37.

The cam 8 is preferably a part of the door 5 and integrally molded or formed therewith and thus the cam 8 and door 5 rotate around the door hinge 17 to open and close the door over the horizontal compartment 19. The cam 8 shown in the door 5 open and closed positions preferably comprises two parallel cams (FIGS. 5*b* and 5*a*) spaced apart so the guide shaft 30 passes between the cams. That construction helps prevent the cams 8 from sliding laterally off the cam follower pin 37 since the parallel cams are constrained to move along the length of the guide shaft 30 which extends between and preferably abuts and slides along the parallel cams 8. The downward motion of the cam follower 37 acts against the cam 8 and rotates the doors to the open position. Release of the handle 7 allows the return springs 42 to close all doors simultaneously because the springs 42 move the cross-pieces 31 upward and as the force from the cross-pieces 31 are removed the springs 28 move the lower spacer 38 and its cam follower 37 upward. The spring 28 provides a resilient force to urge cam follower 37 and thus cam 8 and door 5 toward a closed position.

The above description is given by way of example, and not limitation. Given the above disclosure, one skilled in the art could devise variations that are within the scope and spirit of the invention disclosed herein, including various ways of configuring the shape of the compartments 18 and of varying the number of compartments. Moreover, while the springs 28, 41, 42 are shown as compression coil springs initially affecting movement of the cam pin 30, the springs could be located to primarily act on or contact the cam 8. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A container for storing and dispensing small solid materials, comprising:

a housing having a centrally located longitudinal axis and further having an upper end and a lower end with a plurality of compartments therein, the compartments having an open end adjacent to the upper end of the housing and a lower end adjacent to the lower end of the housing, the lower end of each compartment having an opening with a hinged door covering each of a plurality of the openings;

a plurality of cams each having a cam surface, each cam attached to one of a plurality of the doors so the cam rotates as the attached door opens and closes;

a plurality of cam followers each abutting and translating along a different one of the cam surfaces, each of the cam followers restrained to move along a predefined path as the door attached to the cam is opened and closed;

a tab on one or more doors sufficiently large to allow manual opening of doors individually and against a resilient member urging the doors to a closed position;

a centrally located handle only on a top of the container connected to a linkage mechanism that moves the cam followers to open all doors simultaneously when the handle is pushed down, the handle located on the longitudinal axis; the linkage mechanism comprising a crosspiece located outward of the longitudinal axis and connected to move downwardly with the handle, the crosspiece moving first and second sleeves each sliding along a different one of first and second retaining rods which are generally parallel to the longitudinal axis, each sleeve connected to and moving with a different cam follower.

2. The container of claim 1, wherein the compartments have an inclined or curved back wall oriented to direct items from the upper portion toward the door covering the opening in the lower portion.

3. The container of claim 1, wherein the housing has a base connected to a rotating support so the container can rotate.

4. The container of claim 1, wherein each cam has opposing cam surfaces and one of the cam followers is located between those opposing cam surfaces.

5. The container of claim 1, wherein each of the cams comprises two parallel cams offset a distance apart to straddle a shaft from which one of the cam followers extends to engage each of the parallel cams.

6. The container of claim 1, wherein there are six compartments, each with a one of the doors covering the opening to the compartment.

7. The container of claim 1, wherein the housing has a base connected to a rotatable base to rotate the housing.

8. The container of claim 1, wherein each of the cam followers comprises a pin.

9. A container for storing and dispensing small solid materials, comprising:

a housing having a centrally located longitudinal axis and having an upper end and a lower end with a plurality of compartments therein, the compartments having an open end adjacent the upper end of the housing and a lower end adjacent the lower end of the housing, the lower end of each compartment having an opening with a hinged door covering the opening;

a cam surface extending from at least some of the doors and a different cam follower abutting each cam surface, each cam follower being slidably mounted to move along an axis parallel to the longitudinal axis with the cam or cam follower resiliently urged to a position corresponding to a selected position of the door;

a centrally located handle having a shaft extending therefrom along the longitudinal axis with at least one flange extending outward from the shaft and sized to fit within a slot on the container when the shaft is rotated, with engagement of the flange and slot holding the shaft in a predetermined vertical position relative to the housing; and means for moving the cam follower by moving the handle, the means including a linkage having a crosspiece located outward of the longitudinal axis and moving with the handle, the crosspiece moving first and second sleeves each sliding along a different one of first and second retaining rods which are generally parallel to the longitudinal axis, each sleeve connected to and moving with a different one of the cam followers.

10. The container of claim 9, wherein there are six compartments.

11. The container of claim 9, wherein there are six compartments each with a rectangular opening covered by the door.

12. The container of claim 9, further including a return spring to push the handle back to an extended position thereby moving each of the cam followers to a door closed position.

13. The container of claim 9, further including a return spring resiliently urging the handle and flange into a position away from the slot.

14. The container of claim 9, further comprising means connected to the housing for rotating the container.

15. A container for storing and dispensing items from covered compartments, comprising:

a housing having a plurality of compartments having a vertical portion extending along a longitudinal axis and a horizontal portion with an opening in the vertical portion to introduce items into the compartment and an opening in the horizontal portion to remove items upward from the compartment and a plurality of covers each entirely covering one of the openings in the horizontal portion;

a cam extending from each of at least some of the covers, the cam engaging a cam follower pin constrained to move in a vertical path with a resilient member resiliently urging the cam and cam follower into a position in which the cover blocks the lower opening associated with each cover;

a centrally located handle movably mounted along the longitudinal axis;

a linkage mechanism connecting the handle to each of the cam follower pins so that movement of the handle along the longitudinal axis moves the cam follower pins against the force of the resilient member associated with that cam follower pin, the linkage mechanism having a crosspiece located outward of the longitudinal axis and moving with the handle, the crosspiece moving first and second sleeves each sliding along a different one of first and second retaining rods which are generally parallel to the longitudinal axis, each sleeve connected to and moving with a different one of the cam followers.

16. The container of claim 15, further comprising a rotatable base fastened to the housing to allow rotation of the housing about the vertical axis.

17. The container of claim 15, wherein the cam comprises two parallel cams offset a distance apart to straddle a shaft from which the cam follower extends to engage each of the parallel cams.

* * * * *